US007341018B2

(12) United States Patent
Greenberg et al.

(10) Patent No.: US 7,341,018 B2
(45) Date of Patent: Mar. 11, 2008

(54) BOAT WITH RETRACTABLE DECK MOUNTED RUMBLE SEAT

(75) Inventors: Robert A. Greenberg, Bradenton, FL (US); Kevin A. Tucker, Sarasota, FL (US)

(73) Assignee: Chris Craft Corporation, Sarasota, FL (US)

( * ) Notice: Subject to any disclaimer, the term of this patent is extended or adjusted under 35 U.S.C. 154(b) by 0 days.

(21) Appl. No.: 11/673,733

(22) Filed: Feb. 12, 2007

(65) Prior Publication Data

US 2007/0186841 A1 Aug. 16, 2007

Related U.S. Application Data

(60) Provisional application No. 60/772,959, filed on Feb. 14, 2006.

(51) Int. Cl.
*B63B 17/00* (2006.01)

(52) U.S. Cl. ..... 114/363; 296/66

(58) Field of Classification Search ..... 114/85, 114/343, 363, 364; 296/63, 66; 297/331, 297/354.1, 378.1, 378.12, 378.13, 378.14
See application file for complete search history.

(56) References Cited

U.S. PATENT DOCUMENTS

| | | | | |
|---|---|---|---|---|
| 2,502,061 | A * | 3/1950 | Radford | 296/66 |
| 3,202,453 | A * | 8/1965 | Richards | 296/66 |
| 4,763,598 | A | 8/1988 | Spencer | |
| 6,019,413 | A * | 2/2000 | Scraver et al. | 296/66 |
| 6,024,397 | A * | 2/2000 | Scraver et al. | 296/66 |
| 6,497,192 | B2 | 12/2002 | Fecht | |
| 6,945,190 | B1 | 9/2005 | Frandsen | |

* cited by examiner

*Primary Examiner*—Lars A. Olson
(74) *Attorney, Agent, or Firm*—Caesar, Rivise, Bernstein, Cohen & Pokotilow, Ltd.

(57) ABSTRACT

A boat having a deck section, e.g., a forward deck, having an opening in which a pivotable seat assembly is located. The pivotable seat assembly includes a seat that mounted on a frame and is arranged to be pivoted from a closed position, wherein the back of the seat forms a hatch closing the opening in the deck section, to an open position wherein plural passengers can be seated on the seat in the deck section. The frame pivotably supports the seat. A hydraulic actuating system under electrical control is provided arranged to pivot the seat between its closed and open positions and vice versa.

19 Claims, 3 Drawing Sheets

BOAT WITH RETRACTABLE DECK MOUNTED RUMBLE SEAT

CROSS-REFERENCE TO RELATED APPLICATIONS

This application claims priority from provisional U.S. Patent Application No. 60/772,959, filed on Feb. 14, 2006 whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to boats and more particularly to boats having a built-in retractable seat located in the deck.

BACKGROUND OF THE INVENTION

Numerous closed-deck runabout boats are commercially available. As is known such boats typically include a hull having a passenger seating area or cockpit and a forward or front deck that is "closed." The front deck may include a hatch to provide access to items stored below the front deck. Persons wishing to sit at the front of such closed-deck boats are therefore resigned to sitting or reclining on the front deck. This may present a safety hazard, depending upon water conditions, weather, etc. The patent literature includes some disclosures of boats having openable areas in the front deck to enable passengers to be seated therein. For example, in U.S. Letters Pat. No. 4,763,598 (Spencer) there is disclosed a boat having multiple panels attached to each other and to the deck of the boat. The panels are movable to more than one position and have different uses in each position. When lowered into a cabin area they provide a large opening in the deck and provide an additional useful function such as the formation of seats or of ladder steps. When raised they form a part of the deck and close the opening in the deck to provide weather protection and security for the cabin.

In U.S. Letters Pat. No. 6,497,192 (Fecht) there is disclosed a boat having a sunken seating area in the bow of the boat. This seating area is hidden by a panel. The panel is movable to expose and allow access to the bow seating area.

In U.S. Letters Pat. No. 6,945,190 (Frandsen) there is disclosed a boat having a seat back system that includes a pair of seat benches for mounting to the floor of an open bow section of the boat. The seats face each other along an axis parallel to the keel of the boat. Each seat back is individually mounted to pivot from a vertical, seat back attitude, to a horizontal attitude covering over the open bow section. The boat of this patent includes an arrangement for pivoting the seat backs that can be hydraulic, pneumatic or mechanical. To that end, each makes use of an extending piston between the boat floor and at a location along a brace that is secured to a seat back side, extending at a right angle therefrom, with piston extension to provide seat back travel, providing a load bearing deck.

While the boats of the aforementioned patents may be generally suitable for their intended purposes, they nevertheless leave much to be desired from various standpoints, such as functionality, ease of use and operation and aesthetics. The boat of the subject invention addresses those needs.

SUMMARY OF THE INVENTION

In accordance with one aspect of the invention there is provided a boat having a forward deck section located adjacent the bow of the boat and having an opening in which a pivotable seat assembly is mounted. The seat assembly comprises a seat member and means for pivoting the seat member from a retracted position to an extended position and vice versa.

The seat member has a base wall and a back wall fixedly secured thereto at an angle to the base wall and having an outer surface and an inner surface. The base wall has an outer surface and an inner surface. The inner surface of the back wall portion is adapted to accommodate the back of a person seated on the seat member. The inner surface of the base wall is adapted to accommodate the buttocks and legs of a person seated on the seat member. The outer surface of the back wall is constructed to serve as a portion of the forward deck section of the boat.

The seat member is mounted within the opening in the forward deck and is coupled to the seat moving means for pivoting the seat member from the retracted position wherein the outer surface of the back wall is generally horizontal and flush with the forward deck section contiguous with the opening, thereby effectively closing the deck section, to an extended position wherein the outer surface of the back wall is generally vertically, whereupon at least one person can be seated on the seat within the opening in the deck. When so seated the person's back is against the inner surface of the back wall and with the person's buttocks and legs supported on the inner surface of the base wall.

Another aspect of this invention entails the pivotable seat assembly itself, which assembly can be incorporated in the forward deck of a boat or any other deck portion of a boat (as will be described later). Moreover, the pivotable seat assembly may be constructed and arranged to be retrofitted into existing boats having a deck in which an opening exists or which can be formed therein to accommodate the pivotable seat assembly.

DETAILED DESCRIPTION OF THE PREFERRED EMBODIMENT

Figure 1:
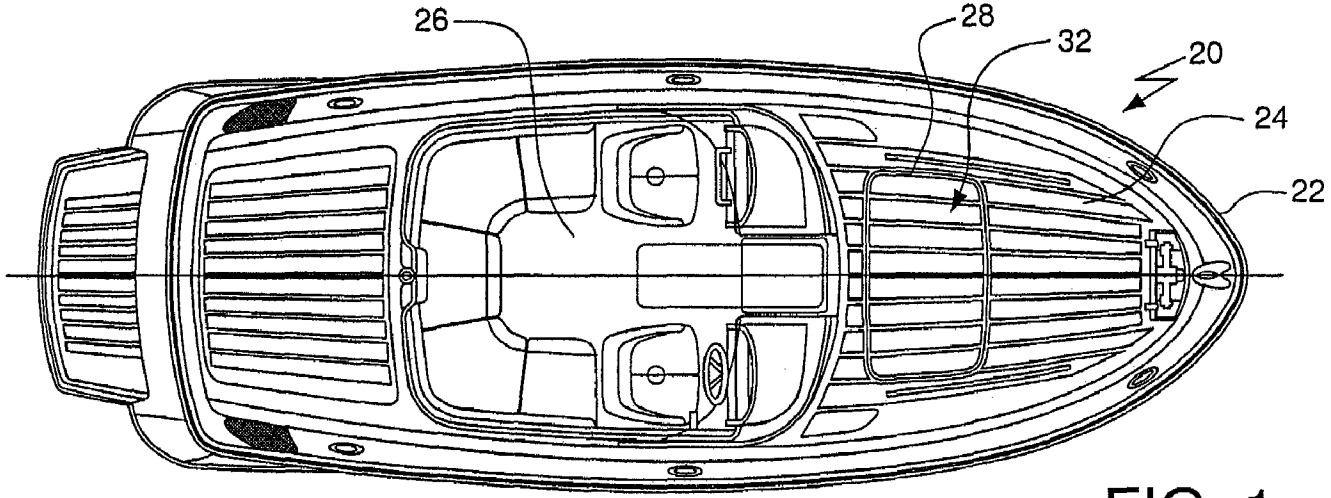
FIG. 1 is a top plan view of one exemplary boat a pivotable seat located in the front deck constructed in accordance with this invention, with the seat being shown in its retracted or stored position.
Figure 2:
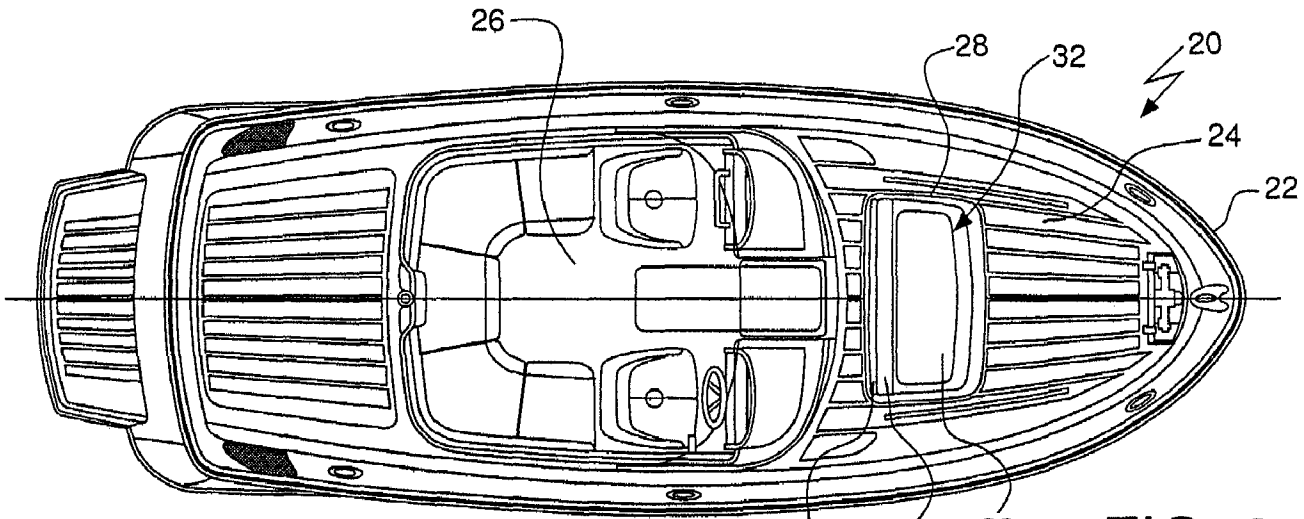
FIG. 2 is a top plan like FIG. 1, but showing the seat in its extended position ready for one or more persons to be seated thereon.
Figure 3:
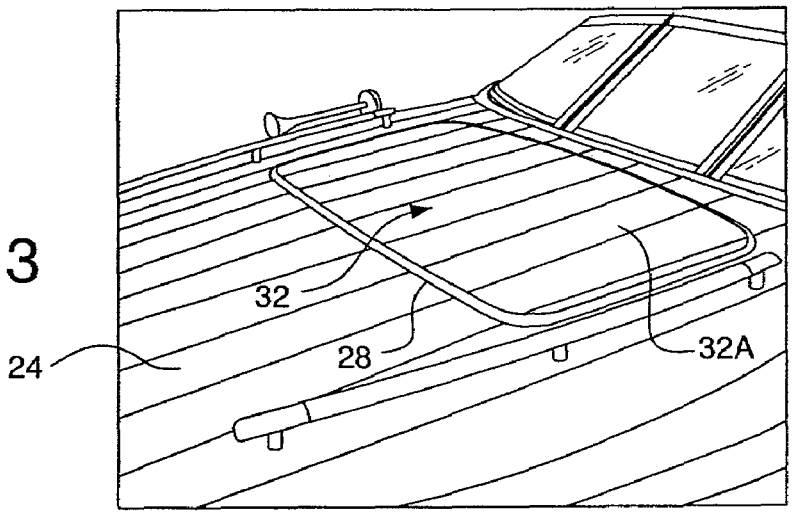
FIG. 3 is an isometric view of a portion of the front deck section of the boat shown in FIGS. 1 and 2, with the seat being shown in its retracted position.

Referring now to the various figures of the drawing wherein like reference characters refer to like parts, there is shown in FIG. 1 a boat 20 constructed in accordance with one exemplary embodiment of this invention. The boat 20 basically comprises a hull 22, a front deck 24, and a passenger receiving compartment or cockpit 26 located to the rear of the front deck. A windshield may be provided separating the front deck from the cockpit as shown in FIGS. 1-5. The boat can be made of any suitable conventional material, e.g., fiberglass, and its hull preferably includes a liner. The front deck section includes a generally rectangular opening 28 therein. A pivotable seat assembly 30, similar to what is commonly referred to as a "rumble seat" for an automobile, is mounted in the opening 28. The details of the seat assembly will be described later. Suffice for now to say that the seat assembly includes a bench type seat 32 (FIGS. 2-5) and a system 34 (FIG. 6) for pivoting the seat. In particular, the seat 32 is arranged to be pivoted from a closed position, like that shown in FIGS. 1 and 3, to an open position, like shown in FIGS. 2 and 5. When the seat 32 is in the closed or retracted position the back wall of the seat 32 effectively forms a "hatch" for closing off the opening 28 as best seen in FIG. 3. To that end, the outer surface of the back wall of the seat is contoured so that it will be generally flush or otherwise compatible with the contour of the portion of the front deck 24 contiguous with the opening 28. In accordance with one preferred embodiment of the invention the hatch can be molded as part of the deck as it is built. When the seat 32 is in the open or extended position the back wall is oriented so that it is substantially vertical to serve as the backrest of the seat. Another portion of the seat 32 serves as the seating surface on which one or more persons may sit when the seat is in the open position.

Turning now to FIGS. 1-5, the details of the seat 32 will now be described. The seat 32 basically is a bench-type member comprised of the heretofore identified back wall, now designated by the reference number 32A (FIGS. 2-5) and bottom or base wall (not shown). The back wall and the bottom wall may be individual components which are fixedly secured together, e.g., they can be formed of fiberglass and "glassed" together. Alternatively, the seat may be molded as a one-piece component. In any case, the back wall 32A is fixedly secured to the bottom wall and extends at approximately 90 degrees or a slightly greater angle thereto. As mentioned earlier, the back wall includes an outer surface. That surface forms the outer surface of the "hatch" in the front deck of the boat when the seat assembly is in its closed position as shown in FIGS. 1 and 3. The back wall 32 also includes an inner surface on which a pad 36 is located. The inner surface of the bottom wall of the seat member also includes a pad 38 thereon, as shown clearly in FIGS. 2, 4 and 5. The pad 36 is arranged to receive the back of any person sitting on the seat, while the pad 38 is adapted to receive and support the buttocks and upper legs of the person. In the embodiment shown the seat is shown configured to accommodate two passengers side-by-side. Depending upon the beam of the boat, the seat may be configured to accommodate more than two persons.

Figure 7:
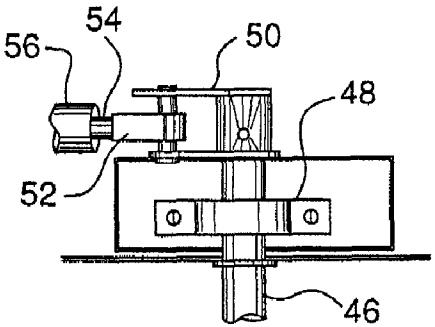
FIG. 7 is an enlarged top plan view of a portion of the system shown in FIG. 6.
Figure 6:
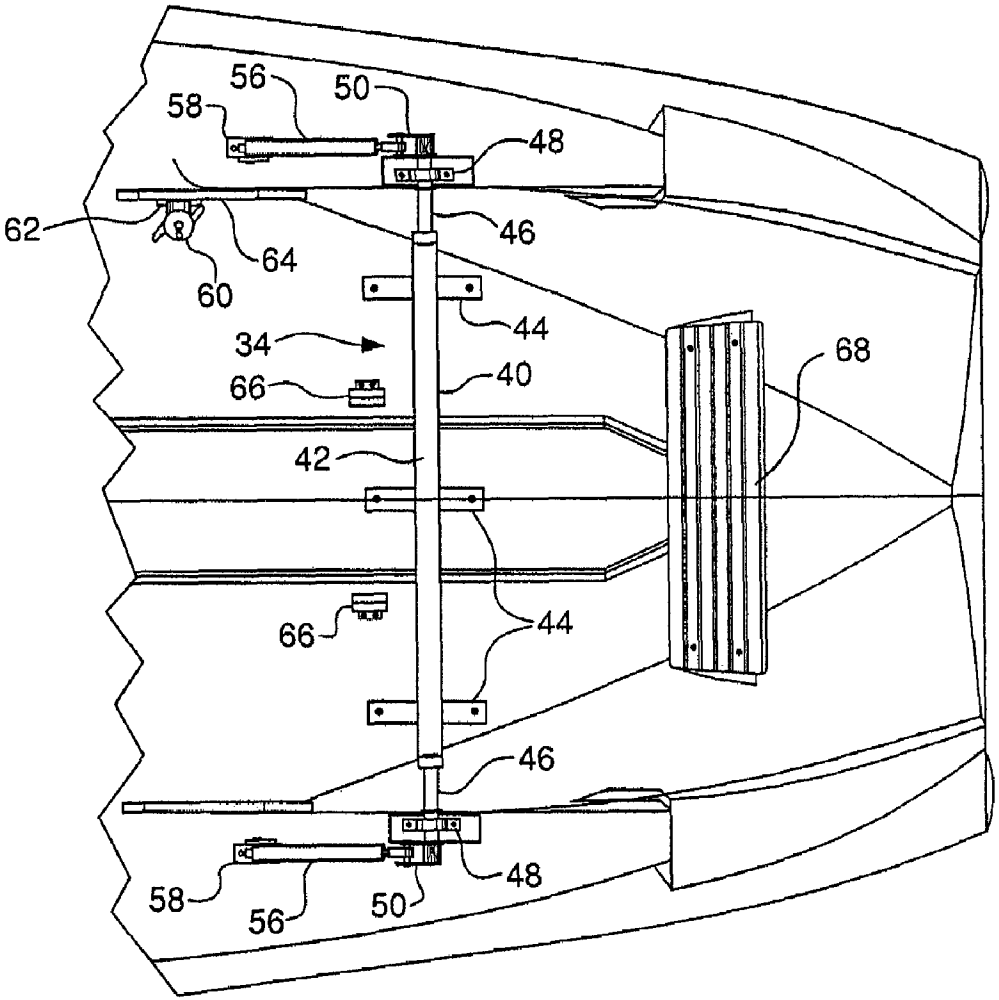
FIG. 6 is a top plan view of a portion of the system for effecting the movement of the seat from its retraced to its extended position and vice versa.

In FIG. 6 there is shown a somewhat schematic diagram of the system 34 for effecting the pivoting or rotation of the seat 32 between its closed and open positions and vice versa. The seat 32 itself is not shown in FIG. 6. The seat is mounted on a seat pivoting assembly 40 forming a portion of the system 34. That assembly 40 basically comprises a frame 42 arranged to be fixedly secured to the bottom or outer surface of the base portion of the seat to support the seat thereon. To that end, the frame 42 includes plural flanges 44 that are secured to the outer (bottom) surface of the bottom wall of the seat. The frame is preferably a powder coated aluminum structure, but can be formed of any suitable material(s). A pair of pivot shafts 46 extend from opposite ends of the frame 42 and as best seen in FIG. 7 are journaled through respective ones of two nylon adjustable bearing mounts 48. Each bearing mount is mounted on respective support portions of the liner in the boat's hull. A respective pivot arm assembly 50 (also best seen in FIG. 7) is secured to the end of each of the pivot shafts 46 of the seat support frame 42. Each pivot arm assembly 50 is in turn connected via a clevis 52 to a piston rod or ram 54 of a respective hydraulic cylinder 56. The housing of each hydraulic cylinder is secured to the liner in the boat's hull by means of a clevis and pin assembly 58. The hydraulic cylinders 56 are actuated by a common hydraulic pump 60 through associated conduits (not shown). A remote control box 62 is mounted on a upstanding board 64 of the boat's liner and is arranged to receive a radio frequency signal from a remote control actuator (not shown) to cause the pump 60 to operate and thereby drive the hydraulic cylinders 56. The remote control actuator may be a separate hand-holdable unit, e.g., a key fob, or may be a rocker switch or other switch mounted on the dashboard of the boat or at any other desired position. The remote key fob is typically found on today's motor vehicles, and with the subject invention brings this remote control technology into the marine industry. The key fob is preferably arranged to operate the opening and closing of the deck hatch, along with the operation of the cockpit lights of the boat via the boat's 12 volt electrical system (not shown).

Figure 8:
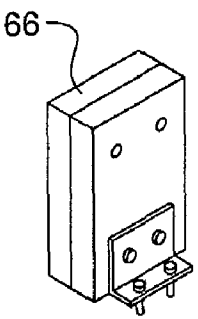
FIG. 8 is an enlarged isometric view of a portion of the system shown in FIG. 6.

In order to provide additional support for persons sitting on the seat, a pair of support blocks 66, like shown in FIGS. 6 and 8 are mounted on the liner in the boat's hull so that their upper surface engages and supports the bottom surface of the seat when the seat is in the open position. In the interest of comfort, a footrest 68, such as a slatted teak member, can be located on the liner within the hull of the boat immediately forward of the pivoting seat 32.

Figure 4:
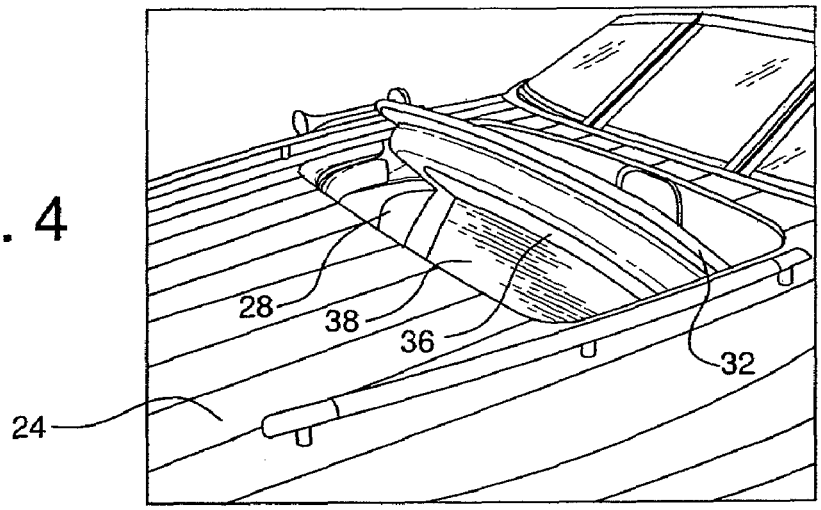
FIG. 4 is a view similar to FIG. 3 but showing the seat in its retracted position, like shown in FIG. 1.
Figure 5:
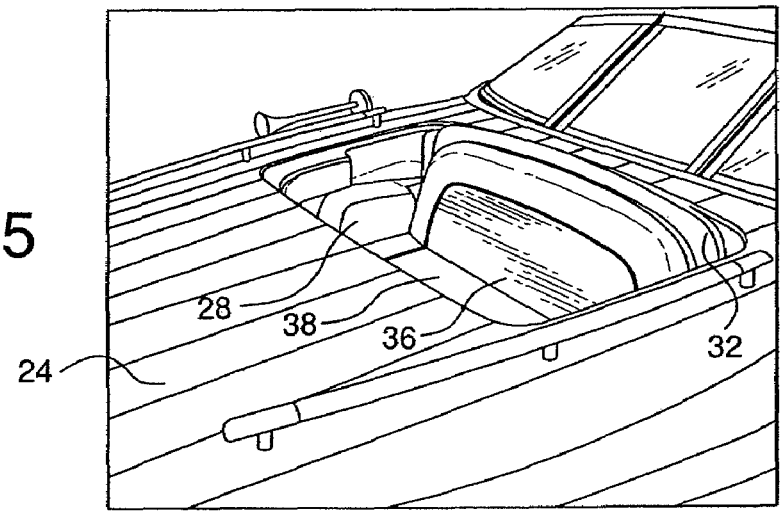
FIG. 5 is view similar to FIGS. 3 and 4 but showing the seat in an intermediate position, e.g., in the process of being moved from its retracted position to its extended position or vice versa.

Operation of the pivotable seat 32 is as follows. When it is desired to open the seat, i.e, to cause it to move from the retracted position shown in FIGS. 1 and 2, the remote control fob or rocker switch can be pressed, thereby sending a radio frequency signal to the remote control box 62. If desired the remote actuator may be an IR device. In any case, upon receipt of the actuating signal from the actuator, the pump 60 will be actuated, thereby introducing hydraulic fluid into both cylinders 56 to cause their respective piston rods 54 to extend out of their respective housings, whereupon the associated pivot arms 50 will begin to pivot to cause the seat 32 to begin to move (rotate) to the open position. In FIG. 4, the seat is shown the seat 32 at an intermediate position as it is moved from the closed position to the open position. When the piston rod or ram 54 has reached the end of its travel, the seat 32 will be in its fully open or extended position as shown in FIGS. 2 and 5. One or more passengers can then sit on the bench seat facing forward.

When the seat is no longer required for use by passengers, it can be pivoted back to the retracted position shown in FIGS. 1 and 3 to thereby close the front deck. To that end the remote actuator is actuated, thereby causing the pump 60 to withdraw hydraulic fluid from the associated hydraulic cylinders 56, whereupon the rods 54 of those cylinders retract. The retraction of the rods cause the concomitant rotation of the pivot arms 50 in the opposite direction, whereupon the seat frame 42 is rotated in the opposite direction so that the seat's back wall 32A assumes its horizontal or flush orientation with the contiguous portion of the deck 24, thereby closing the opening 28 therein.

It should be pointed out at this juncture that any or all of the deck, seat, seat support and the 12 volt electric/hydraulic system for pivoting the seat as described above are exemplary of various components/assemblies that can be used to accomplish the goals of the subject invention. For example other systems can be used to effect the pivoting action of the seat, e.g., pneumatic cylinders, electric motors or other actuatable devices can be used in lieu of the disclosed hydraulic cylinders. Moreover, the system may only utilize one such device instead of the two as described above. Further still, the components forming the support for the seat and the components coupling the seat to the devices for effecting its extension retraction can be different than those described above, so long as they enable the seat to be moved readily from its retracted position, wherein the seat is concealed under the deck, to its extended position, wherein the seat can readily accommodate passengers thereon, and vice versa. The construction of the seat itself may be different than that disclosed. For example, it may not include padding, its inner surfaces may be contoured to ergonomically accommodate the body of the passengers, etc.

While not shown, the boat of the subject invention makes use of a drain and seal system for the "rumble seat" and associated front deck to ensure that the boat exhibits features similar to a conventional closed deck run-about insofar as water intrusion is concerned. In particular, the drain system is constructed so that the actual deck and rotating fiberglass parts allow water drainage overboard. To that end, the drain system utilizes a drip edge and plastic push in drains to control water flow. This system connects to a hose which drains directly overboard through a stainless steel fitting on the hull side. The perimeter of the rotating hatch and seat part includes a seal system, comprising a "D" shaped foam rubber seal that mounts using a high strength VBM tape. This seal performs the functions of a compression seal, while maintaining the shape to keep the opening between the two parts to a minimum to eliminate water intrusion. The foam seal is ultraviolet protected as it will be exposed to the elements. The adhesive tape that secures the seal is also of considerable importance. One particularly good tape is a high strength VBM tape. This adhesive is extremely durable and requires preparation of the mounting surface before installation of the seal.

As should be appreciated from the foregoing the subject invention incorporates a traditional automobile "rumble seat" design into the closed front deck of a boat. This construction enables the boat to exhibit the features and aesthetics of a conventional closed deck runabout, which is typically sold in colder climates, to blend with an open bow rider model. Thus, the boat of the subject invention allows for two persons to be seated side-by-side and facing forward. In short the boat of the subject invention is the best of both worlds. Moreover, the seat and associated components of subject invention are constructed and arranged to enables the seat's extension/retraction to be readily accomplished by means of an electrically initiated signal. If desired, the pivoting of the seat between its retracted and extended positions can be effected manually, although such an arrangement is not preferred. In any case, the extension/retraction of the rumble seat is accomplished by the subject invention without sacrificing aesthetics. For example, the retractable/extendable seat of this invention enables a boat having such a system to make use of a standard closed deck with a conventional, e.g., diamond, non-skid surface.

As mentioned earlier, while the pivotable seat assembly of subject invention has been described with respect to being mounted within an opening in the forward deck of a boat, and has particular utility therein to provide the passengers on the seat with a "front row" view as the boat travels, such an arrangement is merely exemplary. Thus, the pivotable seat assembly of this invention can be mounted in any opening in any deck, e.g., a rear deck, or any portion of a deck of a boat.

Without further elaboration the foregoing will so fully illustrate our invention that others may, by applying current or future knowledge, adopt the same for use under various conditions of service.

We claim:

1. A boat having a deck section comprising a deck having an opening therein in which a pivotable seat assembly is mounted, said seat assembly comprising a seat member and seat moving means for pivoting said seat from a retracted position to an extended position and vice versa, said seat member having base wall and a back wall fixedly secured thereto at an angle to said base wall and having an outer surface and an inner surface, said base wall having an outer surface and an inner surface, said inner surface of said back wall portion being adapted to accommodate the back of a person seated on said seat member, said inner surface of said base wall being adapted to accommodate the buttocks and legs of a person seated on said seat member, said outer surface of said back wall being constructed to serve as a portion of said forward deck section of said boat, said seat being mounted within said opening and coupled to said seat moving means for pivoting said seat member from said retracted position wherein said outer surface of said back wall is generally horizontal and flush with said forward deck section contiguous with said opening, thereby effectively closing said deck section, to an extended position wherein said outer surface of said back wall is generally vertically, whereupon at least one person can be seated on said seat member within said opening in said deck with the person's back against the inner surface of said back wall and with the person's buttocks and legs supported on said inner surface of said base wall.

2. The boat of claim 1 wherein at least one of said inner surface of said back wall of said seat member and said inner surface of said base wall of said seat member is padded.

3. The boat of claim 1 wherein said seat member is mounted on a frame, said frame being pivotably mounted between a pair of support members.

4. The boat of claim 3 wherein said frame includes portions extending through respective bearings.

5. The boat of claim 1 wherein said means for pivoting said seat member comprises a fluid pump.

6. The boat of claim 5 wherein said fluid pump is a hydraulic pump.

7. The boat of claim 5 wherein said means for pivoting said seat member additionally comprises at least one gear coupled to said fluid pump.

8. The boat of claim 1 wherein said seat member comprises a bench seat that is sufficiently wide to accommodate two persons.

9. The boat of claim 1 additionally comprising a remote hand-held actuatable device for effecting the operation of said seat moving means for pivoting said seat from a retracted position to an extended position and vice versa.

10. The boat of claim 1 wherein said deck comprises a forward deck section located adjacent the bow of the boat and wherein said deck section includes said opening, with said pivotable seat assembly being mounted therein

11. A pivotable seat assembly for a boat having a deck section, the deck section having a deck with an opening therein in which said pivotable seat assembly is mounted, said seat assembly comprising a seat member and seat moving means for pivoting said seat from a retracted position to an extended position and vice versa, said seat member having base wall and a back wall fixedly secured thereto at an angle to said base wall and having an outer surface and an inner surface, said base wall having an outer surface and an inner surface, said inner surface of said back wall portion being adapted to accommodate the back of a person seated on said seat member, said inner surface of said base wall being adapted to accommodate the buttocks and legs of a person seated on said seat member, said outer surface of said back wall being constructed to serve as a portion of the forward deck section of the boat, said seat being mounted within the opening and coupled to said seat moving means for pivoting said seat member from said retracted position wherein said outer surface of said back wall is generally horizontal and flush with the forward deck section contiguous with the opening, thereby effectively closing the deck section, to an extended position wherein said outer surface of said back wall is generally vertically, whereupon at least one person can be seated on said seat member within the opening in the deck with the person's back against the inner surface of said back wall and with the person's buttocks and legs supported on the inner surface of said base wall.

12. The pivotable seat assembly of claim 11 wherein at least one of said inner surface of said back wall of said seat membe and said inner surface of said base wall of said seat member is padded.

13. The pivotable seat assembly of claim 11 additionally comprising a frame and a pair of support members, said seat member being mounted on said frame, said frame being pivotably mounted between said pair of support members.

14. The pivotable seat assembly of claim 13 wherein said frame includes portions extending through respective bearings.

15. The pivotable seat assembly of claim 11 wherein said means for pivoting said seat member comprises a fluid pump.

16. The pivotable seat assembly of claim 15 wherein said fluid pump is a hydraulic pump.

17. The pivotable seat assembly of claim 15 wherein said means for pivoting said seat member additionally comprises at least one gear coupled to said fluid pump.

18. The pivotable seat assembly of claim 11 wherein said seat member comprises a bench seat that is sufficiently wide to accommodate two persons.

19. The pivotable seat assembly of claim 11 additionally comprising a remote hand-held actuatable device for effecting the operation of the means for pivoting said seat from a retracted position to an extended position and vice versa.

* * * * *